US005135632A

United States Patent [19]

Weber

[11] Patent Number: 5,135,632

[45] Date of Patent: Aug. 4, 1992

[54] APPARATUS FOR ELECTROPOLISHING SURFACES

[75] Inventor: Robert Weber, Uttenreuth, Fed. Rep. of Germany

[73] Assignee: Siemens Aktiengesellschaft, Munich, Fed. Rep. of Germany

[21] Appl. No.: 683,261

[22] Filed: Apr. 10, 1991

Related U.S. Application Data

[63] Continuation of PCT DE88/00626, Oct. 10, 1988.

[51] Int. Cl.[5] ..... C25D 17/12; C25F 7/00

[52] U.S. Cl. ..... 204/224 M; 204/225; 204/275

[58] Field of Search ..... 204/224 M, 224 R, 275, 204/225

[56] References Cited

U.S. PATENT DOCUMENTS

| | | | |
|---|---|---|---|
| 3,223,610 | 12/1965 | Inoue | 204/224 M |
| 3,546,088 | 12/1970 | Barkman et al. | 204/224 M |
| 4,632,740 | 12/1986 | Operschall | 204/224 R X |
| 4,634,511 | 1/1987 | Operschall et al. | 204/212 |
| 4,810,343 | 3/1989 | Bonnardel | 204/224 M X |
| 4,883,576 | 11/1989 | Gemma | 204/224 M |
| 4,988,414 | 1/1991 | Westerman, Jr. | 204/224 R X |

FOREIGN PATENT DOCUMENTS 0146833 7/1985 European Pat. Off. .

3345278 6/1985 Fed. Rep. of Germany .

*Primary Examiner*—Donald R. Valentine

*Attorney, Agent, or Firm*—Herbert L. Lerner; Laurence A. Greenberg

[57] ABSTRACT

An apparatus for electropolishing surfaces includes an inner housing having an open side with a rim facing toward a surface to be electropolished and being otherwise closed. A guide apparatus moves the inner housing along the surface to be electropolished. An inner seal is disposed between the rim of the inner housing and the surface to be electropolished. An electrode is retained in the inner housing. An outer housing has an interior in which the inner housing and the electrode are disposed. The outer housing has an open side with a rim facing toward the surface to be electropolished and is otherwise closed. An outer seal is disposed on the rim of the outer housing. Connections are associated with the outer housing for supplying and removing a rinsing fluid to and from the inner housing. Ducts are associated with the outer housing for supplying and removing electrolyte fluid to and from the inner housing. Auxiliary devices are connected to the connections and the ducts for supplying rinsing fluid and electrolyte fluid.

12 Claims, 2 Drawing Sheets

APPARATUS FOR ELECTROPOLISHING SURFACES

CROSS-REFERENCE TO RELATED APPLICATION

Figure 1:
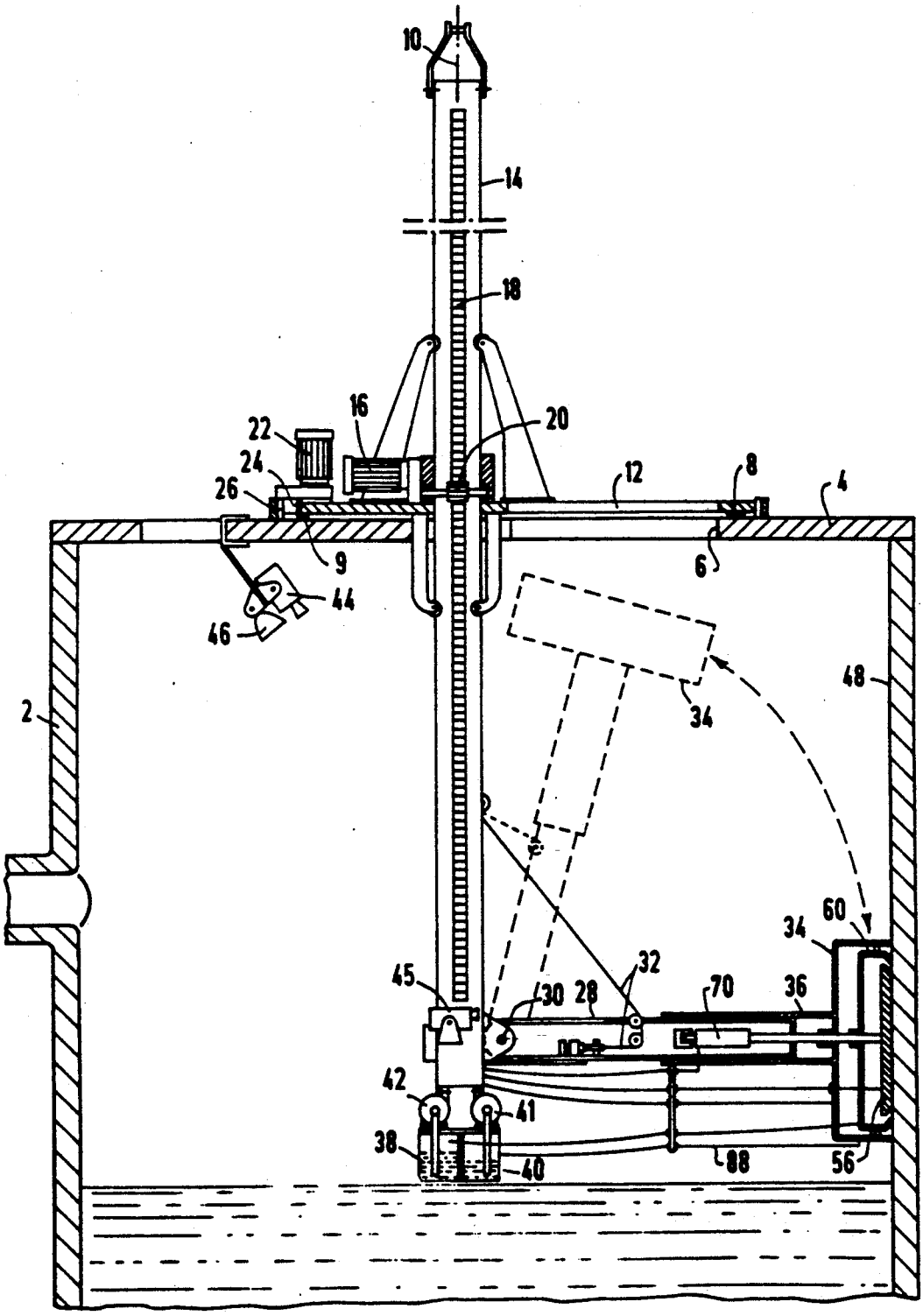

This application is a Ccontinuation of International Application Serial No. PCT/DE 88/00626, filed Oct. 10, 1988.

The invention relates to an apparatus for electropolishing surfaces, including a housing being movable along a surface to be electropolished by means of a guide apparatus and being closed on all sides except for a side oriented toward the surface to be electropolished, a seal disposed between a rim of the housing and the surface to be electropolished, an electrode retained in the housing, and auxiliary devices attached to the housing for supplying current and supplying electrolyte fluid.

It is known from German Published, Non-Prosecuted Application DE 33 45 278 Al, corresponding to U.S. Pat. No. 4,634,511, to decontaminate metal surfaces of nuclear engineering facilities by means of electropolishing. In that apparatus, a sponge electrode, which is retained on a carriage supported on an inner surface of a hollow cylindrical body, is pressed against the inside surface and moved along the surface with the carriage. That apparatus makes quite economical use of the electrolyte, because the electrode is built into a housing that is closed on all sides except for the side on which the electrode rests on the surface to be electropolished.

Electrolyte fluid dripping from the electrode into the housing, which rests with encompassing sealing lips on the surface to be electropolished, is removed by suction and pumped back into an electrolyte supply tank. With that apparatus, good decontamination of tubes and inner surfaces of containers, vessels or tanks has been feasible. Although the spongelike electrode is enclosed by a housing that is open only toward the surface to be decontaminated and can be brought into contact with the surface to be decontaminated by means of a seal, small quantities of electrolyte fluid still remain on the already decontaminated portions of the surface when the housing is displaced. Such electrolyte residues on the decontaminated portions of the surface are a problem when the decontaminated portions of the system are put back into operation. Accordingly, the residues must be removed beforehand by extensive rinsing procedures.

It is accordingly an object of the invention to provide an apparatus for electropolishing surfaces, which overcomes the hereinafore-mentioned disadvantages of the heretofore-known devices of this general type and to do so in such a way that as far as possible no electrolyte residues remain on the decontaminated portions of the surface, or the quantities of such residues are markedly reduced.

With the foregoing and other objects in view there is provided, in accordance with the invention, an apparatus for electropolishing surfaces, comprising an inner housing being closed on all sides except for an open side with a rim facing toward a surface to be electropolished; a guide apparatus for moving the inner housing along the surface to be electropolished; an inner seal disposed between the rim of the inner housing and the surface to be electropolished; an electrode retained in the inner housing; an outer housing having an interior in which the inner housing and the electrode are disposed, the outer housing being closed on all sides except for an open side with a rim facing toward the surface to be electropolished; an outer seal disposed on the rim of the outer housing; connections associated with the outer housing for supplying and removing a rinsing fluid to and from the outer housing; ducts associated with the outer housing for supplying and removing electrolyte fluid to and from the inner housing; and auxiliary devices attached to the inner housing for supplying rinsing fluid and electrolyte fluid.

Since the inner housing along with the electrode is built into the interior of an outer housing that is closed on all sides except for the side oriented toward the surface to be electropolished, and the outer housing has a seal on its rim and is provided both with connections for supplying and removing a rinsing fluid and with ducts for supplying and removing electrolyte fluid to and from the inner housing, it becomes possible for the electrolyte residues remaining on the electropolished surface upon electropolishing and displacement of the two housings to be diluted and rinsed away between the two housings with rinsing fluid. At the same time, precleaning of the portions of the surface to be electropolished is subsequently also attained.

In accordance with another feature of the invention, there are provided means for supporting the inner housing for displacement relative to the outer housing perpendicularly to the open sides of both of the housings. Adaptation to various radii of curvature of container walls and pipelines is made easier in this way. In this case, if the curvature of the wall along with the inner housing is major, the sponge electrode can be displaced farther toward the surface to be electropolished and brought into better contact therewith. The flexible housing seal takes on the task of compensation between the straight housing edge and the curvature of the container wall. Thus even with curved surfaces, the danger of leakage at the seals can be diminished.

In accordance with a further feature of the invention, there are provided means for supporting the electrode in the interior of the inner housing for displacement perpendicularly to the open side of the inner housing. This makes it easier to keep the contact pressure of the electrode virtually constant, despite varying curvatures of the surface to be electropolished.

In accordance with an added feature of the invention, the rinsing fluid is deionized water. Electrolyte contamination of electropolished portions of the surface can be minimized in nuclear engineering facilities if deionized water is used as the rinsing fluid. In this case, the rinsing fluid or deionized water residues that remain on the electropolished surface are readily miscible with the deionized water that is already usually used in the operation of such systems, rendering further treatment or rinsing of the surface unnecessary.

In accordance with an additional feature of the invention, the rims of the inner and outer housings are spaced apart defining a gap therebetween, the connections include a rinsing fluid supply line, and there is provided a ring line connected to the rinsing fluid supply line and secured to the outer housing between the inner and outer housings, the ring line having spray nozzles being secured on the outer housing between the outer and inner housings and being aimed at the gap. Particularly small amounts of electrolyte residue ensue if such a structure is used. In this case, the electrolyte residues are flushed out of the surface by the injection pressure of the rinsing fluid and diluted and removed by suction along with the rinsing fluid.

In accordance with yet another feature of the invention, the rims of the inner and outer housings are spaced apart defining a gap therebetween, and there are provided brushes rotating or oscillating and rubbing the surface to be electropolished in the gap.

In accordance with yet a further feature of the invention, the electrode is a sponge electrode.

In accordance with yet an added feature of the invention, the seals are high-flexibility lip seals.

In accordance with yet an additional feature of the invention, the guide apparatus includes a central main mast with a lower end, a manipulator arm being pivotably supported on the lower end and having an outer end, the outer housing being displaceable on the outer end in the longitudinal direction of the manipulator arm, and the outer housing together with the manipulator arm being rotatably supported about an axis of symmetry of a container having the inner surface to be electropolished.

In accordance with again another feature of the invention, there is provided a turntable for rotating the central main mast about a vertical axis.

In accordance with a concomitant feature of the invention, the auxiliary devices include supply tanks for the electrolyte fluid and the rinsing fluid and associated feed pumps being disposed on the lower end of the main mast.

Other features which are considered as characteristic for the invention are set forth in the appended claims.

Although the invention is illustrated and described herein as embodied in an apparatus for electropolishing surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
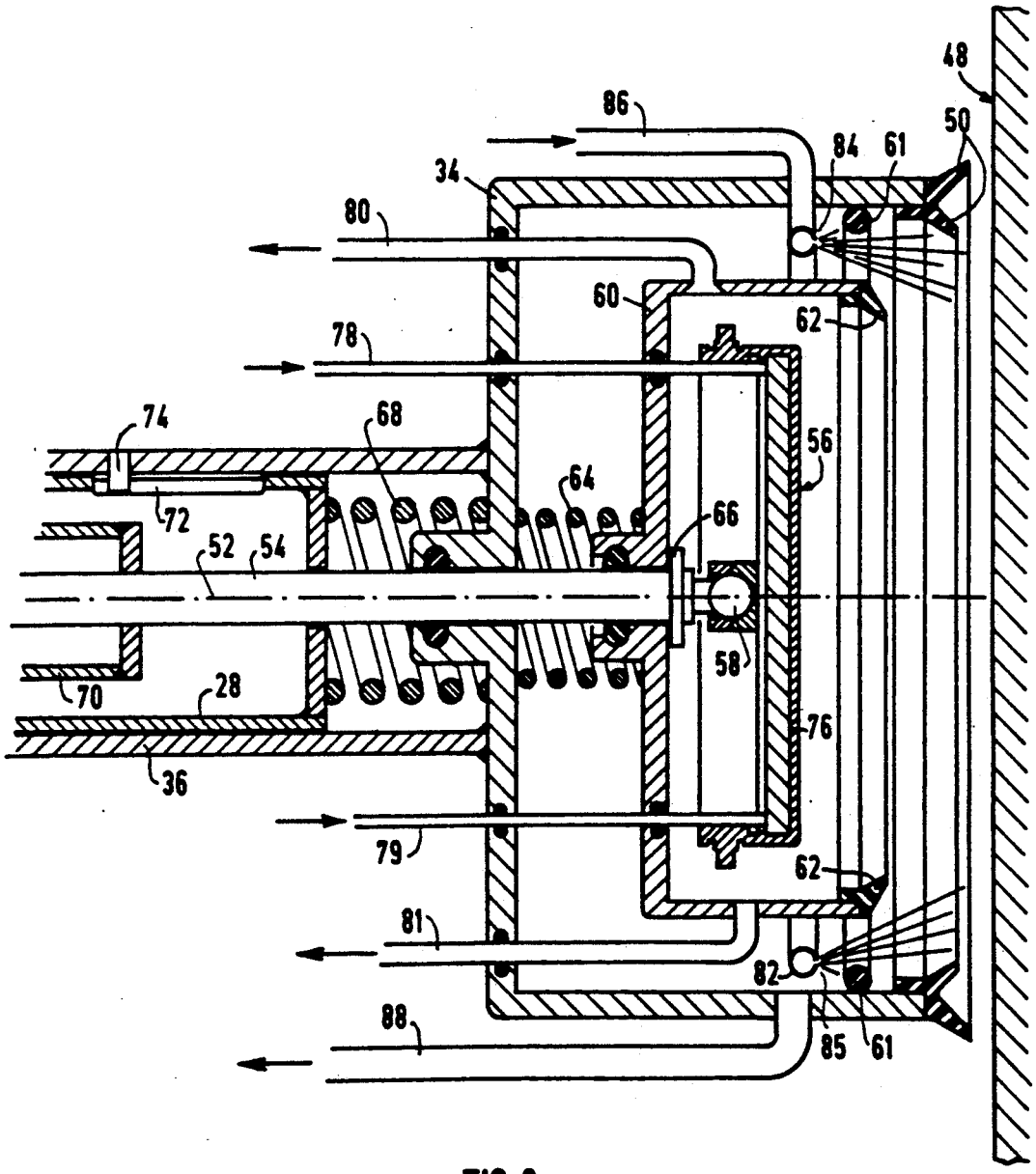

FIG. 1 is a fragmentary, diagrammatic, longitudinal-sectional view of an apparatus according to the invention for electropolishing surfaces, which is mounted on a container to be electropolished; and FIG. 2 is an enlarged, fragmentary, longitudinal-sectional view of the top part of the apparatus according to the invention.

Referring now to the figures of the drawings in detail and first, particularly, to FIG. 1 thereof, there is seen a sectional view of a container, vessel or tank 2 to be decontaminated, and a working platform 4 having a central opening 6 and being mounted on the container 2. A turntable 12 is supported through the opening 6 and is rotatable with rollers 8, 9 (only two of which are shown) on the working platform 4 about an axis of symmetry 10 of the container 2. A central main mast 14 is guided on the turntable 12 in such a way that it is displaceable perpendicularly to the plane of the platform. The vertical displacement of the main mast 14 is effected through a vertical drive mechanism 16 which is diagrammatically illustrated in the drawing, by means of a pinion 20 that meshes with a rack 18 of the main mast. The rotation of the main mast 14 about the axis of symmetry 10 of the container 2 is effected by a horizontal drive mechanism 22 that is secured to the rim of the turntable 12, by means of a pinion 24 that meshes with a gear ring 26 of the working platform 4. A manipulator arm 28 is pivotably supported about a horizontal shaft 30 on the lower end of the main mast 14. The pivoted position of the manipulator arm is adjusted through a cable drive mechanism 32. An outer housing 34 of the apparatus for electropolishing surfaces is secured on the manipulator arm 28 to a support arm 36 that is longitudinally displaceable on the manipulator arm 28. A deionized water tank 38, an electrolyte tank 40, and a respective circulating pump 41, 42 for each of the deionized water and electrolyte fluid are secured to the lower end of the central main mast 14. Television cameras 44, 45 and a lighting fixture 46 are secured to the lower surface of the working platform 4 and to the lower end of the main mast 14.

In the view shown in FIG. 2, which is on a larger scale than FIG. 1, the outer housing 34 that is retained by means of the support arm 36 on the manipulator arm 28, can be seen along with all of its built-in fixtures. The outer housing 34 has a cylindrical outline and is closed on all sides, except for the side opposite the support arm 36. The rim on the open side of the outer housing 34 has a seal 50 facing a surface 48 of the container 2 to be electropolished A die or plunger 54 is longitudinally displaceably supported along the axis of symmetry 52 of the support arm 36, all the way through both the support arm 36 and the outer housing 34. A sponge electrode 56 is supported by means of a ball joint 58 on the forward end of the die 54, in such a way as to be pivotable in two dimensions. A somewhat smaller inner housing 60 is longitudinally displaceably supported on the die 54 between the sponge electrode 56 and the outer housing 34. This inner housing 60 is likewise closed on all sides, except for a side facing the surface to be electropolished. In the exemplary embodiment, the cross section of the housing 60 is again cylindrical, and it is supported with an extensively pierced annular bead 61 on the inner wall surface of the outer housing 34. An encompassing seal 62 is likewise attached to the rim of the inner housing 60 and can be made to engage the surface 48 to be electropolished. The inner housing 60 as well as the die 54 and the sponge electrode 56 are pressed out of the outer housing 34 toward the surface 48 to be electropolished, through the use of a spring 64 which is drawn or folded over the die 54. The spring 64 is supported at one end on the inner housing 60 and at the other on the outer housing 34. A further spring 68 is fastened between the outer housing 34 and the manipulator arm 28 and presses the outer housing 34 away from the manipulator arm.

As can be seen in FIG. 1, the die 54 is at the same time a piston rod of a hydraulic cylinder 70 which is built into the interior of the manipulator arm 28. The die 54 can thus be extended into the manipulator arm 28 or retracted from it again counter to the force of the springs 64, 68. A disk 66 which is secured to the die 54 strikes the inner housing 60 and transmits the backward motion of the die 54 to both housings 34, 60. The support arm 36, which firmly welded to the outer housing 34, is in turn longitudinally displaceably moved by the manipulator arm 28. An adjustment path of the support arm 36 on the manipulator arm 28 is defined by a contact pin 74 of the support arm that plunges into a longitudinal groove 72 in the manipulator arm.

A sponge 76 of the sponge electrode 56 is connected to the electrolyte circulating pump 42 through two pipelines 78, 79, which pass through the rear wall of both the inner and outer housings to deliver electrolyte fluid. The inner housing also communicates with the electrolyte tank 40 through at least one pipeline 80, 81 which pass through the rear wall of the outer housing 34 for the removal of electrolyte fluid by suction. The outer housing 34 has a ring line 82 on the inside thereof, which has spray nozzles 84, 85 aimed at the electropolishing surface 48. The ring line 82 is connected to the rinsing fluid pump 41 through a rinsing fluid supply line 86. The outer housing 34 is also connected to a suction removal line 88 for rinsing fluid This suction removal line 88 discharges into the rinsing fluid tank 38, which in the exemplary embodiment is filled with deionized water.

For instance, in order to electropolish the inner wall surface 48 of the container 2 with this apparatus, first the central main mast 14 is lowered to the desired height by means of the vertical drive mechanism 16, and then the manipulator arm 28 is pivoted by the cable drive mechanism 32 into the working position, or in other words into the horizontal position in the exemplary embodiment. In this position, the sponge electrode 56, the inner housing 60 and the outer housing 34 can be pressed by the springs 64, 68 against the surface to be electropolished, or in other words, in this exemplary embodiment, against the inner wall surface 48 of the container 2, by expansion of the hydraulic cylinder 70. In this process the seal 50 of the outer housing 34 is pressed against the container wall by the spring 68 which is supported on the outer housing and on the manipulator arm 28. The seal 62 of the inner housing 60 is pressed against the container wall 48 by the spring 64 which is fastened between the inner housing and the outer housing In this position of the two housings, the hydraulic cylinder 70 can additionally press the die 54 and the sponge electrode 56 against the container wall to be polished.

Once the apparatus has thus been placed in the working position, the sponge electrode 56 can be supplied with electrolyte fluid through the pipelines 78, 79 and the electrolyte circulating pump 42. The excess electrolyte is removed by suction back into the electrolyte tank from the inner housing 60 through the suction removal lines 80, 81. Additionally, the circulating pump 41 forces rinsing fluid, which is deionized water in the exemplary embodiment, out of the deionized water container 38 into the ring line 82 and through the spray nozzles 84, 85 (only two of which are shown). The deionized water collecting in the outer tank is removed by suction back into the rinsing fluid tank 38 through the suction removal line 88. Upon closure of the housing through the surface of the container, a superficial removal of material from the container wall then takes place when the current is switched on The particles that are removed are sponged away by the electrolyte fluid and are removed with it by suction into the electrolyte tank 40 through the pipelines 80, 81. They can be filtered out in a non-illustrated manner through an interposed filter device. The electropolished regions of the container wall, which come into view under the seal or sealing lip 62 of the inner housing 60 when the housings are displaced, are moistened with slight quantities of electrolyte fluid. These residues of electrolyte fluid are rinsed away between the inner and outer housings by the rinsing fluid that is sprayed with increased pressure at the container wall from the spray nozzles 84, 85, so that once these electropolished, decontaminated portions of the surface come into view at the seal 50 of the outer housing 34, they are substantially no longer moistened with anything but rinsing fluid, which in the present case is deionized water.

The removed deionized water can be selectively replaced with fresh deionized water, or the removed deionized water can be prepared upstream of the return line leading into the rinsing fluid tank in a non-illustrated manner. It is also conceivable to install rotating brushes between the inner and outer housings, which brush the surface to be electropolished. This mechanically wipes away electrolyte residues and residues of removed material remaining on the surface. Instead of using spray nozzles, the outer housing 34 can also be fully flooded with deionized water. It is also possible to keep the pressure in the outer housing 34 somewhat above the pressure of the inner housing 60, thereby effectively preventing the electrolyte from escaping from the inner housing. At the same time, this pressure difference can provide for a stronger pressure of the seals or lip seals against the surfaces they contact. This also applies to the inner seal or lip seal 62, if it is made with an inner and an outer lip, in a manner similar to the way in which the outer lip seal 50 is constructed, in a deviation from the exemplary embodiment.

This apparatus effectively prevents electrolyte fluid from escaping through the seal 62 of the inner housing 60 and through the seal 50 of the outer housing 34. A great advantage of this apparatus is that not only are any electrolyte residues still-adhering after electropolishing sponged away, but precleaning of the region that is to be subsequently electropolished is also attainable upon displacement of the apparatus over the surface to be electropolished. Due to its structure, this electropolishing apparatus also enables work to be performed under water. This option of working under water is also highly advantageous, particularly in nuclear engineering facilities, because the radiation load in the surroundings can be reduced effectively in this way. Finally, the progress of the work can be monitored continuously through the use of the television cameras 44, 45 that are secured under the working platform 4 and on the lower end of the main mast 14.

I claim:

1. An apparatus for electropolishing surfaces, comprising an inner housing having an open side with a rim facing toward a surface to be electropolished and being otherwise closed; a guide apparatus for moving said inner housing along the surface to be electropolished; an inner seal disposed between said rim of said inner housing and the surface to be electropolished; an electrode retained in said inner housing; an outer housing having an interior in which said inner housing and said electrode are disposed, said outer housing having an open side with a rim facing toward the surface to be electropolished and being otherwise closed; an outer seal disposed on said rim of said outer housing; connections associated with said outer housing for supplying and removing a rinsing fluid to and from said outer housing; ducts associated with said outer housing for supplying and removing electrolyte fluid to and from said inner housing; and auxiliary devices connected to said connections and said ducts for supplying rinsing fluid and electrolyte fluid.

2. The apparatus according to claim 1, including means for supporting said inner housing for displacement relative to said outer housing perpendicularly to said open sides of both of said housings.

3. The apparatus according to claim 1, including means for supporting said electrode in the interior of said inner housing for displacement perpendicularly to said open side of said inner housing.

4. The apparatus according to claim 1, wherein said rims of said inner and outer housings are spaced apart defining a gap therebetween, said connections include a rinsing fluid supply line, and including a ring line connected to said rinsing fluid supply line, said ring line having spray nozzles being secured on said outer housing between said outer and inner housings and being aimed at said gap.

5. The apparatus according to claim 1, wherein said rims of said inner and outer housings are spaced apart defining a gap therebetween, and including brushes rotating and rubbing the surface to be electropolished in said gap.

6. The apparatus according to claim 1, wherein said rims of said inner and outer housings are spaced apart defining a gap therebetween, and including brushes oscillating and rubbing the surface to be electropolished in said gap.

7. The apparatus according to claim 1, wherein said electrode is a sponge electrode.

8. The apparatus according to claim 1, wherein said seals are high-flexibility lip seals.

9. The apparatus according to claim 1, wherein said guide apparatus includes a central main mast with a lower end, a manipulator arm being pivotably supported on said lower end and having an outer end, said outer housing being displaceable on said outer end in the longitudinal direction of said manipulator arm, and said outer housing together with said manipulator arm being rotatably supported about an axis of symmetry of a container having the inner surface to be electropolished.

10. The apparatus according to claim 9, including a turntable for rotating said central main mast about a vertical axis.

11. The apparatus according to claim 9, wherein said auxiliary devices include supply tanks for the electrolyte fluid and the rinsing fluid and associated feed pumps being disposed on the lower end of said main mast.

12. An apparatus for electropolishing surfaces, comprising an inner housing having an open side with a rim facing toward a surface to be electropolished and being otherwise closed; a guide apparatus for moving said inner housing along the surface to be electropolished; an inner seal disposed between said rim of said inner housing and the surface to be electropolished; an electrode retained in said inner housing; an outer housing having an interior in which said inner housing and said electrode are disposed, said outer housing having an open side with a rim facing toward the surface to be electropolished and being otherwise closed; an outer seal disposed on said rim of said outer housing; and means for supplying and removing a rinsing fluid to and from said outer housing and an electrolyte fluid to and from said inner housing.

* * * * *